US008614720B2

(12) United States Patent
Kim et al.

(10) Patent No.: US 8,614,720 B2
(45) Date of Patent: Dec. 24, 2013

(54) DRIVING DEVICE AND DISPLAY DEVICE INCLUDING THE SAME

(75) Inventors: Ock Jin Kim, Asan-si (KR); Sang-Gon Lee, Dajeon Metropolitan (KR); Yong-Soon Lee, Cheonan-si (KR); Chang Sin Kim, Suwon-si (KR)

(73) Assignee: Samsung Display Co., Ltd. (KR)

( * ) Notice: Subject to any disclaimer, the term of this patent is extended or adjusted under 35 U.S.C. 154(b) by 287 days.

(21) Appl. No.: 13/247,467

(22) Filed: Sep. 28, 2011

(65) Prior Publication Data

US 2012/0256970 A1 Oct. 11, 2012

(30) Foreign Application Priority Data

Apr. 8, 2011 (KR) ..... 10-2011-0032591

(51) Int. Cl.
*G09G 5/10* (2006.01)

(52) U.S. Cl.
USPC ..... 345/690; 345/88; 345/89; 345/204

(58) Field of Classification Search
USPC ..... 345/76, 77, 82, 83, 87–89, 204, 690
See application file for complete search history.

(56) References Cited

U.S. PATENT DOCUMENTS

| | | | | |
|---|---|---|---|---|
| 7,091,937 | B2 | 8/2006 | Nakamura | |
| 7,095,395 | B2 | 8/2006 | Bu | |
| 7,486,303 | B2 | 2/2009 | Akai et al. | |
| 7,642,941 | B2 * | 1/2010 | Tsai et al. | 341/138 |
| 2002/0163490 | A1 * | 11/2002 | Nose | 345/89 |
| 2004/0036672 | A1 * | 2/2004 | Yoo et al. | 345/102 |
| 2007/0241989 | A1 * | 10/2007 | Kim | 345/3.1 |
| 2007/0273677 | A1 * | 11/2007 | Kim | 345/204 |
| 2008/0001901 | A1 * | 1/2008 | Lee | 345/100 |
| 2008/0122814 | A1 * | 5/2008 | Shin et al. | 345/204 |
| 2008/0136761 | A1 * | 6/2008 | Hong et al. | 345/89 |
| 2008/0198118 | A1 * | 8/2008 | Choi | 345/89 |
| 2008/0266276 | A1 * | 10/2008 | Choi et al. | 345/204 |
| 2009/0153593 | A1 * | 6/2009 | Lee et al. | 345/690 |
| 2010/0007639 | A1 * | 1/2010 | Jeong et al. | 345/208 |
| 2011/0058024 | A1 * | 3/2011 | Choi et al. | 348/51 |
| 2011/0090319 | A1 * | 4/2011 | Kim et al. | 348/51 |
| 2011/0205218 | A1 * | 8/2011 | Tsuchi et al. | 345/212 |
| 2011/0216098 | A1 * | 9/2011 | Choi et al. | 345/690 |
| 2012/0120067 | A1 * | 5/2012 | Kim et al. | 345/419 |
| 2012/0127148 | A1 * | 5/2012 | Lee et al. | 345/212 |
| 2012/0169779 | A1 * | 7/2012 | Lee | 345/690 |

FOREIGN PATENT DOCUMENTS

| | | | |
|---|---|---|---|
| JP | 05-019725 | A | 1/1993 |
| JP | 4341597 | B2 | 3/2007 |

(Continued)

*Primary Examiner* — Joe H Cheng
(74) *Attorney, Agent, or Firm* — Cantor Colburn LLP

(57) ABSTRACT

A display device includes a driving device, which includes a signal controller which receives an input image signal and an input control signal and outputs an image data and a data control signal; a reference voltage generator which generates a first reference voltage and a second reference voltage; and a data driver which receives the image data and the data control signal from the signal controller and outputs a data voltage. The data control signal includes a first color gamma control signal, a second color gamma control signal, and a third color gamma control signal. The data driver includes a reference gamma voltage generator which receives the first reference voltage and the second reference voltage from the reference voltage generator, receives the first color, second color, and third color gamma control signals from the signal controller, and generates a reference gamma voltage according to color information of the image data.

20 Claims, 4 Drawing Sheets

(56) References Cited

FOREIGN PATENT DOCUMENTS

| | | | |
|---|---|---|---|
| JP | 2008-209512 | A | 9/2008 |
| JP | 2008-287179 | A | 11/2008 |
| KR | 10-2006-0117026 | A | 11/2006 |
| KR | 10-2007-0078002 | A | 7/2007 |
| KR | 10-2008-0000042 | A | 1/2008 |
| KR | 10-2008-0105642 | A | 12/2008 |
| KR | 10-2010-0005929 | A | 1/2010 |
| KR | 10-2010-0076202 | A | 7/2010 |

* cited by examiner

DRIVING DEVICE AND DISPLAY DEVICE INCLUDING THE SAME

This application claims priority to Korean Patent Application No. 10-2011-0032591 filed on Apr. 8, 2011, and all the benefits accruing therefrom under 35 U.S.C. §119, the entire contents of which are incorporated herein by reference.

BACKGROUND OF THE INVENTION (a) Field of the Invention

The invention relates to a driving device and a display device including the same, and more particularly, to a driving device capable of controlling gamma independently for each of red (R), green (G), or blue (B) colors and a display device including the same.

(b) Description of the Related Art

A general display device includes a display panel assembly which includes a plurality of pixels including a switching element and display signal lines, a gray voltage generator generating reference gray voltage, and a data driver which generates a plurality of gray voltages using the reference gray voltage and applies gray voltage corresponding to an image signal among the generated gray voltage to a data line among the display signal lines as a data signal.

A general gray voltage generator generates a defined number of the reference gray voltages according to a gamma curve of a liquid crystal display. The reference gray voltages include a set having a positive value for a common voltage Vcom and a set having a negative value for the common voltage Vcom. The data driver divides the reference gray voltages to generate gray voltages for an entire gray and may select the data signal among the gray voltages.

In order to implement a color display, each pixel of the display device uniquely displays one of primary colors such as R, G, and B or alternately displays the primary colors with time. Since the pixel displaying each of R, G, and B has a different gamma characteristic, when the same reference gray voltage is used based on the same gamma curve, color sense for each gray may not be uniform or a desired color may not be represented.

The above information disclosed in this Background section is only for enhancement of understanding of the background of the invention and therefore it may contain information that does not form the prior art that is already known in this country to a person of ordinary skill in the art.

BRIEF SUMMARY OF THE INVENTION

The invention provides a driving device having advantages of controlling red (R), green (G), and blue (B) gamma curves independently while reducing the number of transmission signal lines to a data driver and a display device including the same.

An exemplary embodiment of the invention provides a driving device including: a signal controller which receives an input image signal and an input control signal and outputs an image data and a data control signal; a reference voltage generator which generates a first reference voltage and a second reference voltage; and a data driver which receives the image data and the data control signal from the signal controller and outputs a data voltage. The data control signal includes a first color gamma control signal, a second color gamma control signal, and a third color gamma control signal. The data driver includes a reference gamma voltage generator which receives the first reference voltage and the second reference voltage from the reference voltage generator, receives the first color, second color, and third color gamma control signals from the signal controller and generates a reference gamma voltage according to color information of the image data.

The data driver may further include a gray voltage generating circuit which receives the reference gamma voltage and generates gray voltages for entire grays.

The reference gamma voltage generator may include a first resistor array connected between the first reference voltage and the second reference voltage, and a first decoder connected to a node between resistors of the first resistor array. The first decoder may receive the first color, second color, and third color gamma control signals and output the reference gamma voltage.

The gray voltage generating circuit may include a second resistor array connected between the first reference voltage and the second reference voltage.

The data driver may further include a digital-to-analog converter which receives the gray voltages, selects a gray voltage corresponding to the image data and outputs the gray voltage as the data voltage.

The data control signal may further include a polarity control signal which controls a polarity of the data voltage. The gray voltages may include a negative-polarity gray voltage and a positive-polarity gray voltage, and the digital-to-analog converter may select one of the negative-polarity gray voltage and the positive-polarity gray voltage according to the polarity control signal.

The data control signal may further include a data information signal including color information of an image.

Another exemplary embodiment of the invention provides a display device including the driving device and a display panel including a plurality of pixels.

According to exemplary embodiments of the invention, in generating the reference gamma voltages, the data driver receives the gamma control signals for each of R, G, and B from the signal controller to respectively generate the reference gamma voltages for each R, G, or B. Thus, gamma correction and color correction can be easily performed and color adjustment can be performed by controlling the luminance of the primary colors.

BRIEF DESCRIPTION OF THE DRAWINGS

The above and other features of this disclosure will become more apparent by describing in further detail exemplary embodiments thereof with reference to the accompanying drawings, in which.

DETAILED DESCRIPTION OF THE INVENTION

Figure 1:
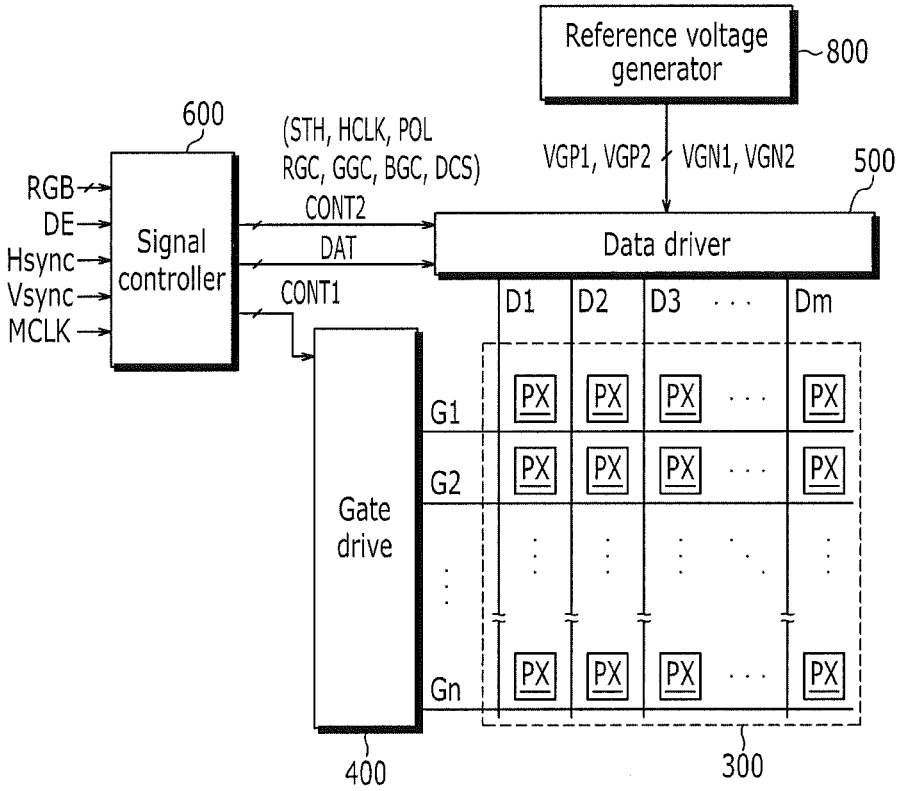
FIG. 1 is a block diagram of an exemplary embodiment of a display device according to the invention.

The invention will be described more fully hereinafter with reference to the accompanying drawings, in which exemplary embodiments of the invention are shown. As those skilled in the art would realize, the described embodiments may be modified in various different ways, all without departing from the spirit or scope of the invention. In the drawings, the thickness of layers, films, panels, regions, etc., are exaggerated for clarity. Like reference numerals designate like elements throughout the specification. As used herein, connected may refer to elements being physically and/or electrically connected to each other. As used herein, the term "and/or" includes any and all combinations of one or more of the associated listed items.

It will be understood that when an element such as a layer, film, region, or substrate is referred to as being "on" another element, it can be directly on the other element or intervening elements may also be present. In contrast, when an element is referred to as being "directly on" another element, there are no intervening elements present.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the invention will be described in detail with reference to the accompanying drawings.

First, an exemplary embodiment of a display device according to the invention will be described with reference to FIG. 1.

FIG. 1 is a block diagram of an exemplary embodiment of a display device according to the invention.

Referring to FIG. 1, the display device includes a display panel 300, a gate driver 400, a data driver 500, a signal controller 600, and a reference voltage generator 800.

The display panel 300 includes a plurality of signal lines G1-Gn and D1-Dm, and a plurality of pixels PX connected thereto and arranged in an approximately matrix shape.

The signal lines G1-Gn and D1-Dm include a plurality of gate lines G1-Gn transmitting gate signals and a plurality of data lines D1-Dm transmitting data voltages.

Each pixel PX includes a switching element (not shown) connected to the signal lines Gi and Dj, and a display element connected thereto. In the case of a liquid crystal display, the display element may be a liquid crystal capacitor. In order to implement a color display, each pixel PX uniquely displays one of the primary colors (spatial division) or alternately displays the primary colors with time (temporal division) so as to allow a desired color to be recognized by the spatial and temporal sum of the primary colors. One exemplary embodiment of the primary colors may be three primary colors such as red (R), green (G), and blue (B).

The signal controller 600 controls the gate driver 400, the data driver 500, the reference voltage generator 800, and the like.

The signal controller 600 receives input image signals R, G, and B and input control signals for controlling display thereof from an external graphic controller (not shown). The input image signals R, G and B include luminance information of each pixel PX and the luminance has a defined number, for example, 1024 ($=2^{10}$), 256 ($=2^{8}$), or 64 ($=2^{6}$) of grays. The input control signals include, but are not limited to, a vertical synchronization signal Vsync, a horizontal synchronizing signal Hsync, a main clock MCLK, a data enable signal DE, and the like. The signal controller 600 appropriately processes the input image signals R, G, and B based on the input image signals R, G, and B and the input control signals, and generates a gate control signal CONT1, a data control signal CONT2, and the like. The signal controller 600 then transmits the gate control signal CONT1 to the gate driver 400, and transmits the data control signal CONT2 and a processed image data DAT to the data driver 500. The image data DAT has a defined number of grays as a digital signal.

The gate control signal CONT1 includes a scanning start signal STV instructing a scanning start, at least one gate clock signal CPV controlling an output timing of gate-on voltage Von, and at least one output enable signal OE defining duration of the gate-on voltage Von.

The data control signal CONT2 includes a horizontal synchronization start signal STH informing a transmission start of the image data DAT of one pixel row, a data clock signal HCLK, a polarity control signal POL controlling voltage polarity of the data signal, R, G, and B gamma control signals RGC, GGC, and BGC, and a data information signal DCS.

The reference voltage generator 800 receives driving voltage AVDD from the outside to generate at least two reference voltages VGP1, VGP2, VGN1, and VGN2 and transmits the reference voltages to the data driver 500. The reference voltages VGP1 and VGP2 have a positive polarity with respect to the common voltage Vcom, and the reference voltages VGN1 and VGN2 have a negative polarity with respect to the common voltage Vcom. The reference voltage VGP1 and the reference voltage VGN1 may have the same magnitude as each other, and the reference voltage VGP2 and the reference voltage VGN2 may also have the same magnitude as each other. In the illustrated exemplary embodiment, the reference voltages were exemplified as having a number of four including the two reference voltages VGP1 and VGP2 having the positive polarity and the two reference voltages VGN1 and VGN2 having the negative polarity, but the number of the reference voltages is not limited thereto.

The data driver 500 is connected with the data lines D1-Dm of the display panel 300. The data driver 500 receives the image data DAT for the pixel PX of one row depending on the data control signal CONT2 from the signal controller 600 and selects the gray voltage corresponding to each image data DAT to convert the image data DAT into the data voltage. The data driver 500 then applies the converted data voltage to the corresponding data lines D1-Dm. The data driver 500 generates a plurality of gray voltages by using the reference voltages VGP1, VGP2, VGN1, and VGN2 provided from the reference voltage generator 800.

An exemplary embodiment of the data driver 500 according to the invention will be described in detail with reference to FIG. 2.

Figure 2:
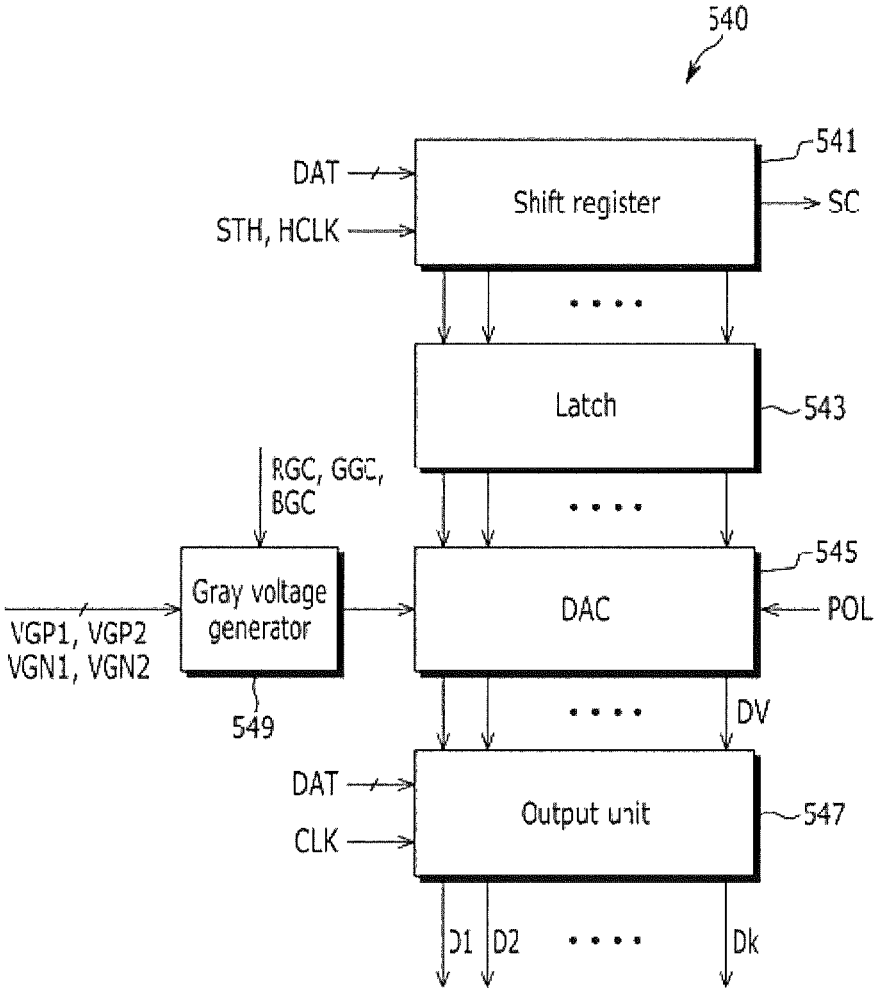
FIG. 2 is a block diagram showing an exemplary embodiment of a data driver of a display device according to the invention.

FIG. 2 is a block diagram showing an exemplary embodiment of a data driver of a display device according to the invention.

The data driver 500 includes at least one data driving circuit 540 shown in FIG. 2, and the data driving circuit 540 includes a shift register 541, a latch 543, a digital-to-analog converter ("DAC") 545, an output unit 547, and a gray voltage generator 549.

When the shift register 541 receives a horizontal synchronization start signal STH, the shift register 541 sequentially shifts an image data DAT inputted according to a data clock signal HCLK to transfer the shifted image data DAT to the latch 543. When the data driver 500 includes a plurality of data driving circuits 540, the shift register 541 shifts all the image data DAT corresponding to the shift register 541 and thereafter, may transmit a shift clock signal SC to a shift register of the adjacent data driving circuit.

The latch 543 sequentially receives and stores the image data DAT from the shift register 541 and outputs the image data DAT of one data line at the same time.

The gray voltage generator 549 receives the reference voltages VGP1, VGP2, VGN1, and VGN2 from the reference voltage generator 800 and the R, G, and B gamma control signals RGC, GGC, and BGC from the signal controller 600 to generate the gray voltages for entire grays. The R, G, and B gamma control signals RGC, GGC, and BGC include an R gamma control signal having information on the R gamma curve, a G gamma control signal having information on the G gamma curve, and a B gamma control signal having information on the B gamma curve.

The digital-to-analog converter 545 receives the gray voltage from the gray voltage generator 549 and converts the image data DAT from the latch 543 into an analog data voltage DV by using the received gray voltage to transmit the converted analog data voltage DV to the output unit 547. The data voltage DV has a positive value or a negative value with respect to the common voltage Vcom, and the polarity of the data voltage DV is determined according to the polarity control signal POL.

The output unit 547 applies the data voltage DV from the digital-to-analog converter 545 to the corresponding data lines D1-Dk based on a clock signal CLK.

Hereinafter, an exemplary embodiment of the gray voltage generator 549 and the digital-to-analog converter 545 of the data driver 500 according to the invention will be described in detail with reference to FIG. 3.

Figure 3:
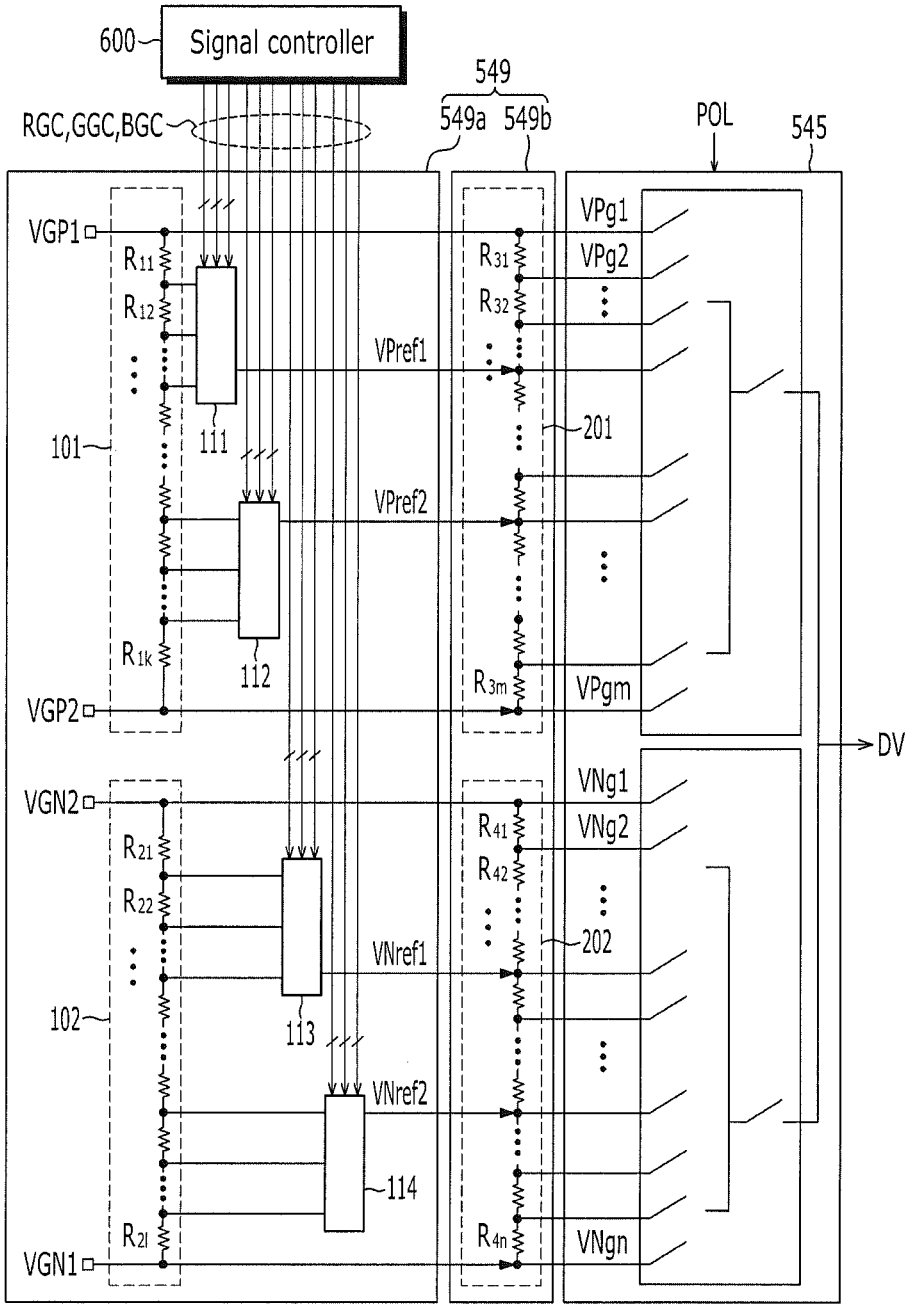
FIG. 3 is a circuit diagram showing an exemplary embodiment of a gray voltage generator and a digital-to-analog converter of the data driver shown in FIG. 2.

FIG. 3 is a circuit diagram showing an exemplary embodiment of the gray voltage generator and the digital-to-analog converter of the data driver shown in FIG. 2.

The gray voltage generator 549 includes a reference gamma voltage generator 549*a* and a gray voltage generating circuit 549*b*.

The reference gamma voltage generator 549*a* includes a first resistor array 101 and a second resistor array 102, a first decoder 111 and a second decoder 112 each connected to a node between resistors of the first resistor array 101, respectively, and a third decoder 113 and a fourth decoder 114 each connected to a node between resistors of the second resistor array 102, respectively.

The first resistor array 101 includes a plurality of resistors $R_{11}$-$R_{1k}$ (herein, k is a natural number) connected in series between the reference voltages VGP1 and VGP2, and the second resistor array 102 includes a plurality of resistors $R_{21}$-$R_{2I}$ (herein, I is a natural number) connected in series between the reference voltages VGN1 and VGN2.

Each of the first decoder 111 and the second decoder 112 is connected to a node between adjacent resistors $R_{11}$-$R_{1k}$ of the first resistor array 101. The first decoder 111 and the second decoder 112 each receives R, G, and B gamma control signals RGC, GGC, and BGC from the signal controller 600 to select voltages of the two nodes of the first resistor array 101 and output the selected voltages as positive-polarity reference gamma voltages VPref1 and VPref2. In this case, the first decoder 111 and the second decoder 112 may be controlled by one of the R, G, and B gamma control signals RGC, GGC, and BGC according to the information on R, G, and B colors for the image included in the data information signal DCS from the signal controller 600. Accordingly, the positive-polarity reference gamma voltages VPref1 and VPref2 outputted from the first decoder 111 and the second decoder 112 are independently generated for each of R, G, or B according to gamma curves of the R, G, and B colors of the corresponding image.

Each of the third decoder 113 and the fourth decoder 114 is connected to a node between adjacent resistors $R_{21}$-$R_{2k}$ of the second resistor array 102. The third decoder 113 and the fourth decoder 114 each also receives R, G, and B gamma control signals RGC, GGC, and BGC from the signal controller 600 to select voltages of the two nodes of the second resistor array 102 and output the selected voltages as negative-polarity reference gamma voltages VNref1 and VNref2. In this case, the third decoder 113 and the fourth decoder 114 may be controlled by one of the R, G, and B gamma control signals RGC, GGC, and BGC according to the information on R, G, and B colors for the image included in the data information signal DCS from the signal controller 600. Accordingly, the negative-polarity reference gamma voltages VNref1 and VNref2 outputted from the third decoder 113 and the fourth decoder 114 are independently generated for each of R, G, or B according to gamma curves of the R, G, and B colors of the corresponding image.

In the exemplary embodiment, the number of the decoders 111, 112, 113, and 114 connected to each of the resistor arrays 101 and 102 are exemplified as two, but the number of the decoders connected to the resistor arrays 101 and 102 is not limited thereto and may be changed.

The gray voltage generating circuit 549*b* includes a third resistor array 201 and a fourth resistor array 202.

The third resistor array 201 includes a plurality of resistors $R_{31}$-$R_{3m}$ (herein, m is a natural number) connected between the reference voltages VGP1 and VGP2 in series, and the fourth resistor array 202 includes a plurality of resistors $R_{41}$-$R_{4n}$ (herein, n is a natural number) connected between the reference voltage VGN1 and VGN2 in series.

The third resistor array 201 receives and divides the reference voltages VGP1 and VGP2 and the positive-polarity reference gamma voltages VPref1 and VPref2 to generate positive-polarity gray voltages VPg1, VPg2, . . . , and VPgm for the entire grays. The fourth resistor array 202 receives and divides the reference voltage VGN1 and VGN2 and the negative-polarity reference gamma voltages VNref1 and VNref2 to generate negative-polarity gray voltages VNg1, VNg2, . . . , and VNgn for the entire grays. In the exemplary embodiment, the number of the positive-polarity gray voltages VPg1, VPg2, . . . , and VPgm may be the same as the number of the negative-polarity gray voltages VNg1, VNg2, . . . , and VNgn (herein, m=n).

The exemplary embodiment of the digital-to-analog converter 545 according to the invention includes a plurality of switches connected with the gray voltage generating circuit 549*b*. The digital-to-analog converter 545 receives the positive-polarity gray voltages VPg1, VPg2, . . . , and VPgm and the negative-polarity gray voltages VNg1, VNg2, . . . , and VNgn and selects the gray voltage corresponding to the image data DAT from each of the gray voltages to output the selected gray voltage as an analog data voltage DV. In this case, the digital-to-analog converter 545 may select one of the negative-polarity gray voltage and the positive-polarity gray voltage according to the polarity control signal POL from the signal controller 600 to output the selected voltage as the data voltage DV.

Hereinafter, an exemplary embodiment of the control signal applied to the data driver from the signal controller of the display device according to the invention will be described with reference to FIG. 4 in addition to FIGS. 1 to 3 described above.

Figure 4:
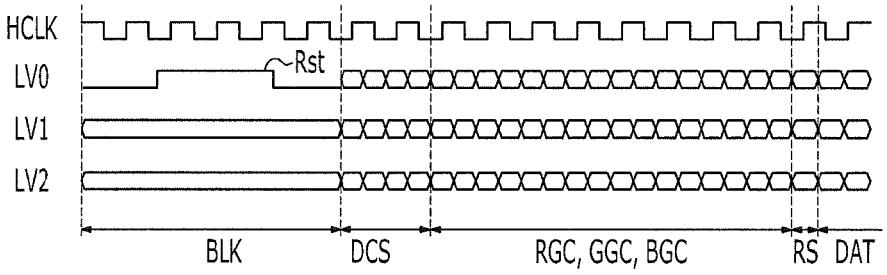
FIG. 4 is an exemplary embodiment of a timing diagram of control signals which are transmitted to a data driver from a signal controller of a display device according to the invention.

FIG. 4 is an exemplary embodiment of a timing diagram of control signals which are transmitted to the data driver from the signal controller of the display device according to the invention.

The signal controller 600 transmits the data control signal CONT2 and the image data DAT to the data driver 500 through first, second, and third data transmission lines LV0, LV1, and LV2 for each frame. In the illustrated exemplary embodiment, the three data transmission lines LV0, LV1, and LV2 are described as an example, but the number of the data transmission lines is not limited thereto and may be changed.

While a blank section BLK continues for the two data transmission lines LV1 and LV2, the remaining data transmission line LV0 transmits a reset signal RST. The reset signal RST is maintained in a high level for a predetermined clock time of the data clock signal HCLK, and then, is changed to a low level.

After the reset signal RST is changed to the low level and then a predetermined clock time elapses, the data information signal DCS is transmitted to the data transmission lines LV0, LV1, and LV2. The data information signal DCS may include information on the image data DAT, for example, information on the R, G, and B colors. The data information signal DCS may be transmitted for approximately two clock times of the data clock signal HCLK.

The data transmission lines LV0, LV1, and LV2 transmit the R, G, and B gamma control signals RGC, GGC, and BGC after the transmission of the data information signal DCS is finished. In the illustrated embodiment, for example, the R, G, and B gamma control signals RGC, GGC, and BGC may be transmitted for approximately eight clock times of the data clock signal HCLK.

After the data information signal DCS and the R, G, and B gamma control signals RGC, GGC, and BGC are transmitted, the data transmission lines LV0, LV1, and LV2 transmit the image data DAT. A reserve signal RS for classify two signals may be further included between transmissions of the image data DAT and the R, G, and B gamma control signals RGC, GGC, and BGC. The reserve signal RS may continue approximately for a half clock time of the data clock signal HCLK.

In addition to the data information signal DCS and the R, G, and B gamma control signals RGC, GGC, and BGC, the polarity control signal POL may be further included between the blank section BLK and the transmission of the image data DAT.

As described above, since the exemplary embodiments of the data driver 500 according to the invention receives the minimum number of reference voltages from the reference voltage generator 800 and generates gray voltages using the reference voltages, the number of the signal transmission lines of the data driver 500 can be minimized, and an area of a printed circuit board ("PCB") including the signal transmission lines can be decreased. Further, since the data driver 500 receives the gamma control signals RGC, GGC, and BGC independently for each of R, G, and B from the signal controller 600 and generates reference gamma voltages independently for each of R, G, or B when the gray voltages are generated in the data driver 500, gamma correction and color correction can be easily performed, and color control can be easily performed by controlling the luminance of the R, G, and B primary colors. Further, the time for the gamma and color correction can be largely reduced.

In the exemplary embodiments of the invention, the three primary colors such as R, G, and B are described as an example of the primary colors represented by the pixel PX, but the primary colors are not limited thereto and may be various three primary colors.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A driving device, comprising:

a signal controller which receives an input image signal and an input control signal, and outputs an image data and a data control signal;

a reference voltage generator which generates a first reference voltage and a second reference voltage; and a data driver which receives the image data and the data control signal from the signal controller and outputs a data voltage, wherein the data control signal includes a first color gamma control signal, a second color gamma control signal, and a third color gamma control signal, and the data driver includes a reference gamma voltage generator which receives the first reference voltage and the second reference voltage from the reference voltage generator, receives the first color, second color, and third color gamma control signals from the signal controller, and generates a reference gamma voltage according to color information of the image data.

2. The driving device of claim 1, wherein:

the data driver further includes a gray voltage generating circuit which receives the reference gamma voltage from the reference gamma voltage generator and generates gray voltages for entire grays.

3. The driving device of claim 2, wherein:

the reference gamma voltage generator includes:

a first resistor array in connection between the first reference voltage and the second reference voltage, and a first decoder in connection to a node between resistors of the first resistor array, and the first decoder receives the first color, second color, and third color gamma control signals and outputs the reference gamma voltage.

4. The driving device of claim 3, wherein:

the gray voltage generating circuit includes a second resistor array in connection between the first reference voltage and the second reference voltage.

5. The driving device of claim 4, wherein:

the data driver further includes a digital-to-analog converter which receives the gray voltages from the gray voltage generating circuit, selects a gray voltage corresponding to the image data and outputs the selected gray voltage as the data voltage.

6. The driving device of claim 5, wherein:

the data control signal further includes a polarity control signal which controls a polarity of the data voltage, the gray voltages include a negative-polarity gray voltage and a positive-polarity gray voltage, and the digital-to-analog converter selects one of the negative-polarity gray voltage and the positive-polarity gray voltage according to the polarity control signal.

7. The driving device of claim 6, wherein:

the data control signal further includes a data information signal including color information of an image.

8. The driving device of claim 1, wherein:

the reference gamma voltage generator of the data driver includes:

a first resistor array in connection between the first reference voltage and the second reference voltage, and a first decoder in connection to a node between resistors of the first resistor array, and the first decoder receives the first color, second color, and third color gamma control signals to output the reference gamma voltage.

9. The driving device of claim 1, wherein:

the data driver further includes a digital-to-analog converter which selects a gray voltage corresponding to the image data and outputs the selected gray voltage as the data voltage.

10. The driving device of claim 9, wherein:

the data control signal further includes a polarity control signal which controls a polarity of the data voltage, the gray voltage include a negative-polarity gray voltage and a positive-polarity gray voltage, and the digital-to-analog converter selects one of the negative-polarity gray voltage and the positive-polarity gray voltage according to the polarity control signal and outputs the selected polarity gray voltage as the data voltage.

11. A display device, comprising:

a display panel including a plurality of pixels;

a signal controller which receives an input image signal and an input control signal, and outputs an image data and a data control signal;

a reference voltage generator which generates a first reference voltage and a second reference voltage; and a data driver which receives the image data and the data control signal from the signal controller, and outputs a data voltage to the display panel, wherein the data control signal includes a first color gamma control signal, a second color gamma control signal, and a third color gamma control signal and the data driver includes a reference gamma voltage generator which receives the first reference voltage and the second reference voltage from the reference voltage generator, receives the first color, second color, and third color gamma control signals from the signal controller, and generates a reference gamma voltage according to color information of the image data.

12. The display device of claim 11, wherein:

the data driver further includes a gray voltage generating circuit which receives the reference gamma voltage from the reference gamma voltage generator and generates gray voltages for entire grays.

13. The display device of claim 12, wherein:

the reference gamma voltage generator includes:

a first resistor array in connection between the first reference voltage and the second reference voltage, and a first decoder in connection to a node between resistors of the first resistor array, and the first decoder receives the first color, second color, and third color gamma control signals and outputs the reference gamma voltage.

14. The display device of claim 13, wherein:

the gray voltage generating circuit includes a second resistor array in connection between the first reference voltage and the second reference voltage.

15. The display device of claim 14, wherein:

the data driver further includes a digital-to-analog converter which receives the gray voltages from the gray voltage generating circuit, selects a gray voltage corresponding to the image data and outputs the selected gray voltage as the data voltage.

16. The display device of claim 15, wherein:

the data control signal further includes a polarity control signal which controls a polarity of the data voltage, the gray voltages include a negative-polarity gray voltage and a positive-polarity gray voltage, and the digital-to-analog converter selects one of the negative-polarity gray voltage and the positive-polarity gray voltage according to the polarity control signal.

17. The display device of claim 16, wherein:

the data control signal further includes a data information signal including color information of an image.

18. The display device of claim 11, wherein:

the reference gamma voltage generator of the data driver includes:

a first resistor array in connection between the first reference voltage and the second reference voltage, and a first decoder in connection to a node between resistors of the first resistor array, and the first decoder receives the first color, second color, and third color gamma control signals and outputs the reference gamma voltage.

19. The display device of claim 11, wherein:

the data driver further includes a digital-to-analog converter which selects a gray voltage corresponding to the image data and outputs the selected gray voltage as the data voltage.

20. The display device of claim 19, wherein:

the data control signal further includes a polarity control signal which controls a polarity of the data voltage, the gray voltage include a negative-polarity gray voltage and a positive-polarity gray voltage, and the digital-to-analog converter selects one of the negative-polarity gray voltage and the positive-polarity gray voltage according to the polarity control signal and outputs the selected gray voltage as the data voltage.

* * * * *